US010801175B2

(12) United States Patent
Evirgen et al.

(10) Patent No.: US 10,801,175 B2
(45) Date of Patent: Oct. 13, 2020

(54) UMBRELLA ANCHORAGE

(71) Applicant: ANADOLU UNIVERSITESI REKTORLUGU, Eskisehir (TR)

(72) Inventors: Burak Evirgen, Eskisehir (TR); Mustafa Tuncan, Eskisehir (TR); Ahmet Tuncan, Eskisehir (TR); Mehmet Inane Onur, Eskisehir (TR)

(73) Assignee: ANADOLU UNIVERSITESI REKTORLUGU, Eskisehir (TR)

( * ) Notice: Subject to any disclaimer, the term of this patent is extended or adjusted under 35 U.S.C. 154(b) by 0 days.

(21) Appl. No.: 16/606,766

(22) PCT Filed: Jul. 3, 2017

(86) PCT No.: PCT/TR2017/050297
§ 371 (c)(1),
(2) Date: Oct. 20, 2019

(87) PCT Pub. No.: WO2019/009822
PCT Pub. Date: Jan. 10, 2019

(65) Prior Publication Data

US 2020/0131729 A1 Apr. 30, 2020

(51) Int. Cl.
*E02D 5/80* (2006.01)
*E02D 17/20* (2006.01)
(Continued)

(52) U.S. Cl.
CPC ..... *E02D 5/803* (2013.01); *E02D 17/20* (2013.01); *E21D 20/028* (2013.01); *E21D 21/008* (2013.01); *E21D 21/0026* (2013.01); *E02D 2200/1685* (2013.01); *E02D 2250/003* (2013.01); *E02D 2250/0038* (2013.01); *E02D 2300/002* (2013.01);
(Continued)

(58) Field of Classification Search
CPC ..... E02D 5/803; E02D 17/20; E21D 20/02; E21D 20/028; E21D 21/0026; E21D 21/008
USPC ..... 405/259.5, 259.1
See application file for complete search history.

(56) References Cited

U.S. PATENT DOCUMENTS 2,873,829 A * 2/1959 Wiegmann ..... E02D 5/803 52/164
3,935,912 A * 2/1976 Shibata ..... E02D 5/803 175/264
(Continued)

FOREIGN PATENT DOCUMENTS

JP 59091221 A * 5/1984 ..... E02D 5/76
JP 02279819 A * 11/1990
(Continued)

OTHER PUBLICATIONS

ISR, dated Mar. 14, 2018.
Written Opinion of the International Searching Authority, dated Mar. 14, 2018.

*Primary Examiner* — Frederick L Lagman
(74) *Attorney, Agent, or Firm* — Crose Law LLC; Bradley D. Crose

(57) ABSTRACT

The invention is an application that completely alter the operating principle and load transfer mechanism of the anchorage technique used in the field of civil engineering, in particular at the excavation bracing and slope stability applications with a novel root zone apparatus.

8 Claims, 2 Drawing Sheets

(51) Int. Cl.
*E21D 20/02* (2006.01)
*E21D 21/00* (2006.01)

(52) U.S. Cl.
CPC ..... *E02D 2300/0029* (2013.01); *E02D 2300/0075* (2013.01); *E02D 2600/30* (2013.01)

(56) References Cited

U.S. PATENT DOCUMENTS

| | | | | |
|---|---|---|---|---|
| 4,015,433 | A | 4/1977 | Shibata | |
| 4,189,879 | A * | 2/1980 | Patterson | E02D 5/803 52/161 |
| 4,576,521 | A * | 3/1986 | Conrad | B63B 21/26 114/293 |
| 4,592,178 | A * | 6/1986 | Lu | E02D 5/803 405/248 |
| 4,697,394 | A | 10/1987 | Lu | |
| 6,685,398 | B1 * | 2/2004 | Gunther | E02D 3/126 405/233 |
| 2015/0252546 | A1 * | 9/2015 | Berger | E02D 5/803 52/160 |

FOREIGN PATENT DOCUMENTS

| | | | | |
|---|---|---|---|---|
| WO | WO-8503047 | A1 * | 7/1985 | E02D 5/808 |
| WO | 2012/134263 | | 10/2012 | |
| WO | WO-2018106204 | A1 * | 6/2018 | E02D 5/74 |

* cited by examiner

UMBRELLA ANCHORAGE

TECHNICAL FIELD

The invention relates to an anchorage system used in the field of civil engineering, in particular at excavation bracing and slope stability applications.

STATE OF ART

The deep foundation requirements for the high-rise buildings constructed within the subject matter of geotechnical department and the increase at the construction of underground structures throughout the world increased the number of studies on soil bracing. The load bearing capacities are improved via anchorage in case the elements such as pile, sheeting pile, retaining walls, etc. used as lateral bracing elements proves to be insufficient.

Within the state of art, application no. EP08700280 defines an anchorage, an anchorage bar rotated at the time of placing the anchorage, the anchorage tray and anchorage nut. The anchorage nut is screwed onto the anchorage bar in order to fix the anchorage tray at its final position on the ground.

Application no. TR2006/06589 defines another anchorage system used at the deep excavations at the building foundations. The load bearing capacity is increased by ensuring that the grouting operation is performed homogenously through anchorage cables (4) being inserted through the hose.

In the present anchorage application technique, after drilling operations are performed at the site in compliance with the project, adequate number of steel cables are placed inside the hole. Then the root zone is formed by performing cement and water grouting, known as blasting, at the final part of the hole.

Endeavors are made to achieve adequate friction force by increasing the length of the root zone as the root zone lacks reinforcement and due to its low diameter. As a consequence of this, anchorage stripping problem emerges due to variation of the existing soil conditions in time (such as rising underground water level). For this reason, serious problems emerge due to collapses at the retaining structure, collapses at the mine and tunnel structures, and loss of life occurs.

The invention proposed herein constitutes an alternate to soil bracing methods currently used in the field of Civil Engineering for slop stability and bracing design. The load bearing capacities are improved via anchorage in case the elements such as pile, sheeting pile, retaining walls, etc. used as lateral bracing elements proves to be insufficient. The invention proposed herein shall enable to use anchorages safely and economically with high efficiency.

The system proposed at the Umbrella Anchorage method shall prevent wearing and stripping of the anchorage by virtue of the high strength of the composite structure formed between the anchorage vanes and concrete grouting.

The Problems that the Invention Aims to Solve

The objective of the invention is to prevent stripping of the anchorage from the concrete by increasing the strength of the anchorage through modifications made at the anchorage design and application, thus preclude probable collapses and loss of life.

Another objective of the invention is to ensure high rate of benefit in terms of workmanship and time by following the stages of boring, sealing, forming root zone through blasting, placing the anchorages, and boring, placing the elements, opening the cutter vanes (1.2.1) and grouting instead of tensioning stages at the standard elements.

Another objective of the invention is to ensure significant financial savings at the bracing systems that include anchorage by reducing the length and number of the anchorage.

Another objective of the invention is to obtain safer retaining structures by ensuring usage of known strength calculations instead of stripping calculations that cause unexpected collapses.

DESCRIPTION OF THE FIGURES

Figure 1:
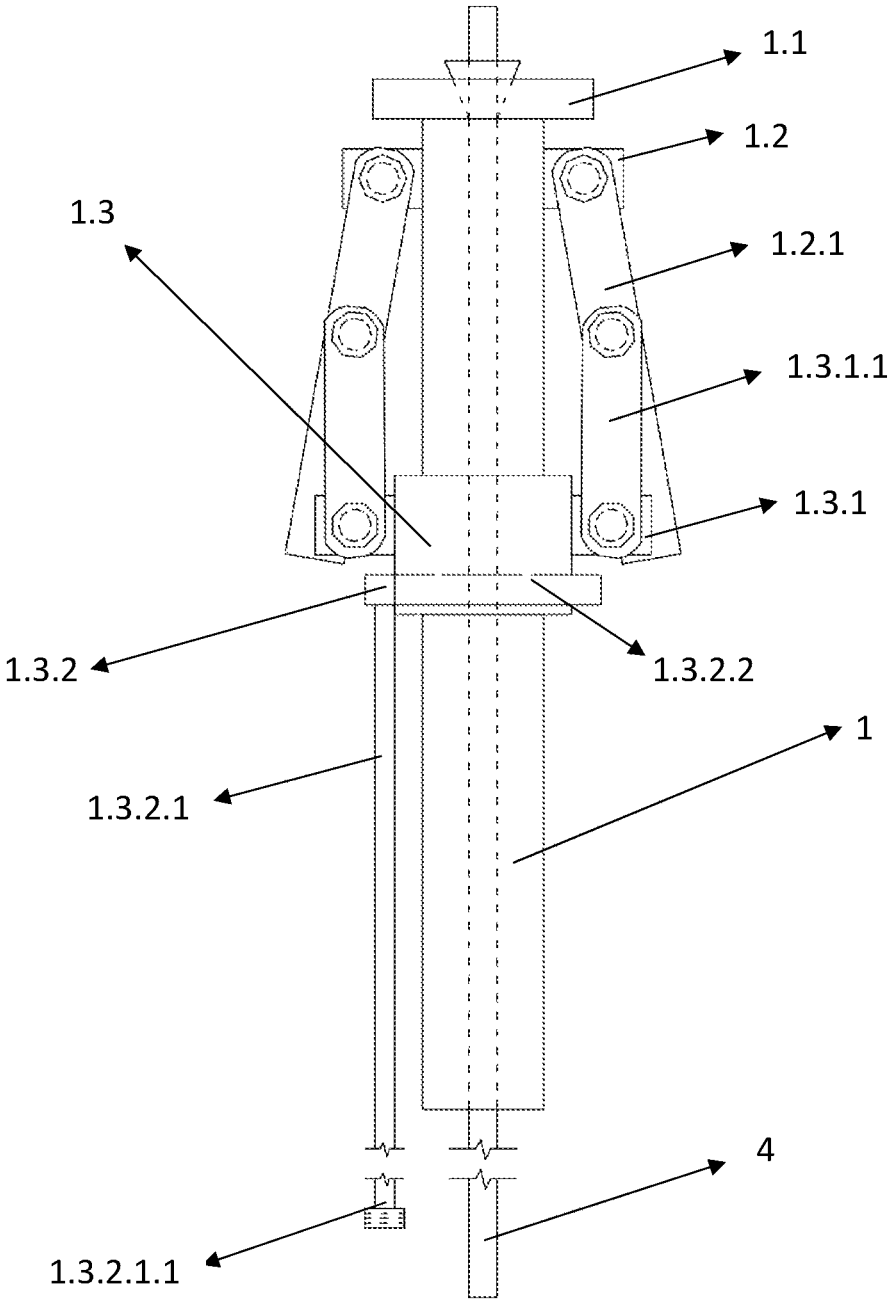
FIG. 1. Umbrella Anchorage Closed Position
FIG. 2. Umbrella Anchorage Open Position
Figure 2:
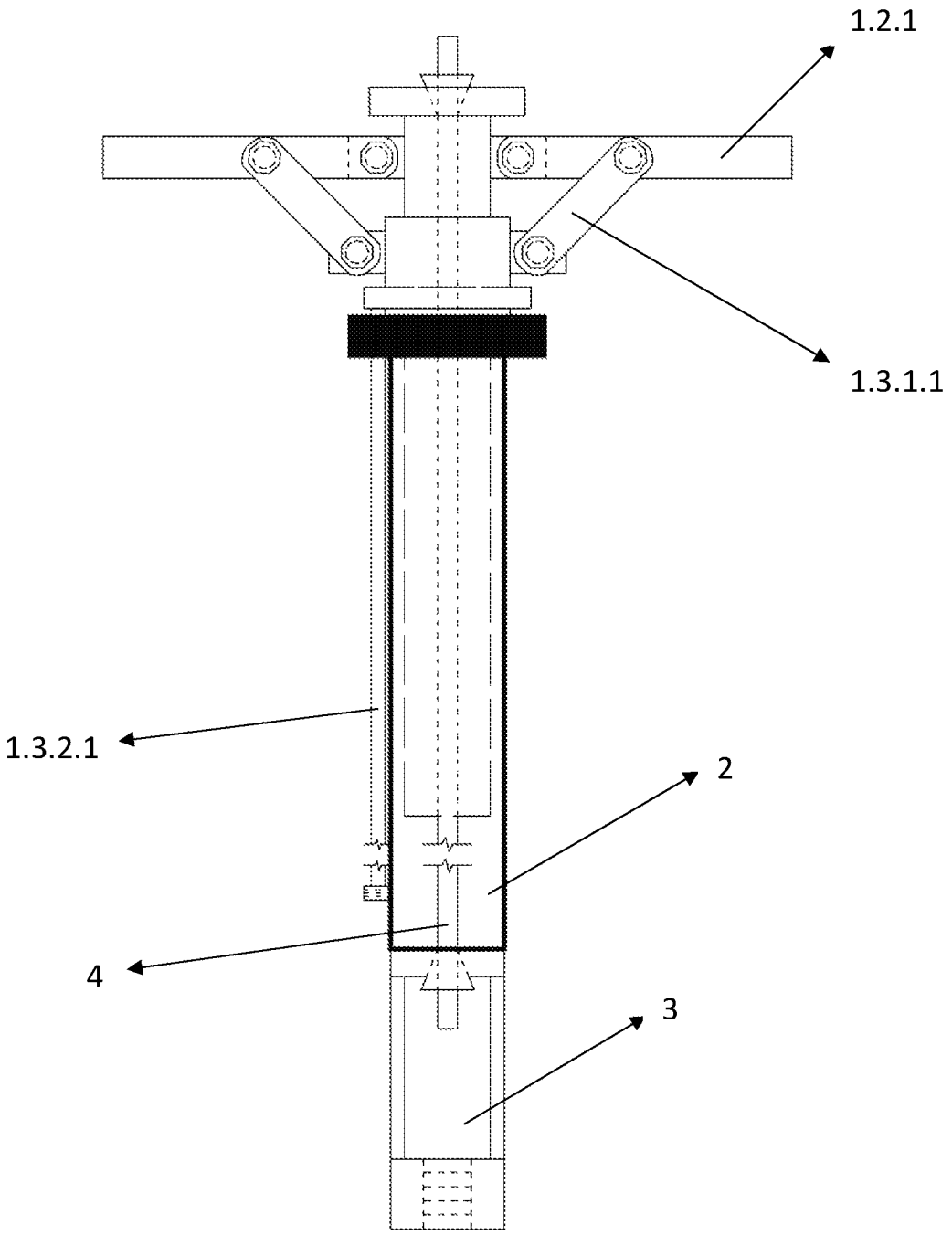

1. Anchorage Body
1.1 Anchorage Cap
1.2 Upper Connection Brackets
1.2.1 Cutter Vanes
1.3 Open-Close Ring
1.3.1 Lower Connection Brackets
1.3.1.1 Support Elements
1.3.2. Grouting Ring
1.3.2.1 Grouting Pipe
1.3.2.1.1 Grouting Coupling
1.3.2.2 Nozzle Orifices
2. Guide Tube
3. Cable Locking Apparatus
4. Anchorage Cable

DESCRIPTION OF THE INVENTION

The invention is an application that alter the operating principle and load transfer mechanism of the anchorage technique used in the field of civil engineering, in particular at the excavation bracing and slope stability applications with the umbrella anchorage structure.

Said umbrella anchorage comprises of the anchorage body (1), the cutter vanes (1.2.1), the support elements (1.3.1.1), the Open-Close ring (1.3), the tensioning element and the grouting system (1.3.2).

The anchorage body (1) is made of steel material and has a cylindrical structure. The anchorage body (1) functions as support for other umbrella anchorage elements. The stationary anchorage cap (1.1) that prevents outflow of concrete from the tip of the anchorage body (1) and that has a spacing at the center that allows the anchorage cable (4) to pass therein is available at the top section, and underneath the anchorage cap (1.1), there are at least two upper connection brackets (1.2) that are positioned perpendicularly to the anchorage body (1) with pin openings thereon and that allow connection of the cutter vanes (1.2.1). The upper connection brackets (1.2) are protrusions that are positioned perpendicularly to the anchorage body (1), to which the support elements (1.3.1.1) will be connected.

The Open-Close ring (1.3), which is a rigid steel element in the form of a collar that surrounds the anchorage body (1) is positioned at the central section of the anchorage body (1). At least two lower connection brackets (1.3.1) and the grouting ring (1.3.2) is positioned stationary on the Open-Close ring (1.3).

The Open-Close ring (1.3) is a rigid steel element that allows the support elements (1.3.1.1) to move and that open the cutter vanes (1.2.1) by moving up to the anchorage cap (1.1) along the anchorage body (1). At least two lower connection brackets (1.3.1) are present on the Open-Close ring (1.3) that are positioned perpendicularly to the Open-Close ring (1.3), where the support elements (1.3.1.1) will be assembled to the round pin openings thereon. The lower connection brackets (1.3.1) are protrusions that are positioned perpendicularly to the Open-Close ring (1.3), top which the support elements (1.3.1.1) will be connected.

At least two cutter vanes (1.2.1) that are fixed to the upper connection brackets (1.2) and the anchorage body (1) are present at the top section of the anchorage body (1) underneath the anchorage cap (1.1). At least two support elements (1.3.1.1) fixed to the Open-Close ring (1.3) with lower connection brackets (1.3.1) are available on the cutter vanes (1.2.1). The cutter vanes (1.2.1) are parts manufactured from steel material designed in the rectangular form longer than the support elements (1.3.1.1) and has the desired sizes according to the soil type, and are suitable for further extension. Anywhere on the cutter vanes (1.2.1) are located the pin openings and the pins where the cutter elements (1.2.1) will be assembled to the support elements (1.3.1.1). The tips of the cutter vanes (1.2.1) that are assembled with the upper connection brackets (1.2) present a blunt structure in order to minimize the friction with the upper connection brackets (1.2) when the umbrella anchorage is switched from closed position to the open position or vice versa.

The cutter vanes (1.2.1) are positioned in such manner to have an acute angle with the ground plan when the umbrella anchorage is at closed position.

The cutter vanes (1.2.1) can achieve open position by making a right angle with the anchorage body (1). Pushing the Open-Close ring (1.3) towards the anchorage cap (1.1) enables moving the support elements (1.3.1.1) in the same direction. In this manner, the cutter vanes (1.2.1) linked to the support elements (1.3.1.1) open perpendicularly to the body.

The grouting system (1.3.2) is positioned at the bottom side above the Open-Close ring (1.3) that allows formation of a composite structure between the cutter vanes (1.2.1) and the cement slurry by performing cement-water grouting to the hole. The grouting system (1.3.2) comprises of the grouting ring (1.3.2) with diameter larger than the Open-Close ring (1.3) that is designed as a round ring that surround the Open-Close ring (1.3) which is fixed on the Open-Close ring (1.3) and the stationary grouting pipe (1.3.2.1) positioned anywhere on the grouting ring (1.3.2), which is hollow and that extend up to the hole exit starting from the grouting ring (1.3.2), and which contains the grouting coupling (1.3.2.1.1) at the end that is not linked to the Open-Close ring (1.3). On the grouting pipe (1.3.2.1), there are round shaped nozzle orifices (1.3.2.2) that enable formation of composite element with both tensile strength and compression strength by spraying pressurized cement-water mixture.

There are at least two support elements (1.3.1.1) with blunt edges positioned on the Open-Close ring (1.3) on the anchorage body (1), with one end fixed to the lower connection brackets (1.3.1) located on the Open-Close ring (1.3), and the other end is fixed to the cutter vanes (1.2.1) at the top section of the anchorage body (1) via pins, that allow the cutter vanes (1.2.1) open with the upward movement of the Open-Close ring (1.3). The ends of the support element (1.3.1.1) that are assembled to the cutter vanes (1.2.1) and the lower connection brackets (1.3.1) has a blunt structure in order to minimize friction with the cutter vanes (1.2.1) and the lower connection brackets (1.3.1) in case the umbrella anchorage is switched to the open position from the closed position or vice versa.

There is a tensioning element on the cutter vanes (1.2.1) made of fabric that ensure connection of the cutter vanes (1.2.1) with each other, positioned in such manner to cover the cutter vanes (1.2.1) like an umbrella canvas.

The tensioning element not only enables all cutter vanes (1.2.1) to move together in the process of opening of the cutter vanes (1.2.1), but also distributes the load acting on the cutter vanes (1.2.1) to wider area, allows grouting by enabling the ground there-between to be drained and allows the system to function efficiently.

When applying the Umbrella Anchorage, firstly a hole is drilled using the auger down to the anchorage application depth. Following hole drilling process, the umbrella anchorage is driven down to the desired depth by means of the guide tube (2) with its cutter vanes (1.2.1) closed and placed there. After the Umbrella Anchorage is placed within the hole, the guide tube (2) is fixed to the Open-Close ring (1.3) and then the cable locking apparatus (3) is placed to the end of the umbrella anchorage. The guide tube (2) ensures that the anchorage cable (4) remains at the center when the umbrella anchorage first opens.

The anchorage cable (4) is inserted through the cable locking apparatus (3) and the Open-Close ring (1.3) is pushed towards the anchorage cap (1.1) along the anchorage body (1) in order to tension the anchorage cable (4) and the support elements (1.3.1.1) open so as to move away from the anchorage body (1). Accordingly, it is further ensured that the cutter vanes (1.2.1) also attain a perpendicular position to the anchorage body (1) and open. Then, the cement-water mixture is supplied to the hole through the nozzle orifices (1.3.2.2) on the grouting pipe (1.3.2.1) using the grouting system (1.3.2). Then the concrete is allowed to set.

After the concrete achieves its strength, the post tensioning is applied by straining the steel tendons. A stable system is achieved by fixing the tendons to the lateral beams by means of clips. In this manner, the concrete block is formed at the end section of the anchorage.

The invention claimed is:

1. An anchorage system used particularly in excavation supporting and slope stability applications in the field of constructional engineering, wherein the anchorage system comprises;

open-close ring (1.3) comprising multiple lower connection brackets (1.3.1) that are fixedly and mountedly positioned, that allow the coupling of support elements (1.3.1.1), that is positioned anywhere on anchorage body (1) and that open cutter vanes (1.2.1) by enabling the movement of support elements (1.3.1.1) and multiple cutter vanes (1.2.1) cutting the surface during the deployment of umbrella-shape anchorage, support elements (1.3.1.1) that ensure the cutter vanes (1.2.1) to assume a vertical position by anchorage body (1) during the deployment of umbrella-shape anchorage by the movement of open/close ring (1.3) towards the surface where anchoring shall be performed, guide tube (2) that gets fixed to anchorage system once the anchorage system is inside hole after the anchorage body (1) drives the anchorage to desired depth and that ensures anchorage cable (4) to remain at the center, anchorage cable (4) that ensures the anchorage body (1) to pass through grouting pipe (1.3.2.1) in hollow tube form, grouting ring (1.3.2) positioned at the bottom side of open/close ring (1.3) and that ensures the formation of a composite structure between cutter vanes (1.2.1) and cement grouting by injecting cement water into well.

2. The anchorage system according to claim 1, wherein the grouting ring (1.3.2) assembled and fixed on the open-close ring (1.3) of the system has a diameter larger than the open-close ring (1.3).

3. The anchorage system according to claim 1, wherein the lower connection brackets (1.3.1) are protrusions where support elements (1.3.1.1) are vertically positioned to open-close ring (1.3) are to be coupled.

4. The anchorage system according to claim 1, wherein the grouting ring (1.3.2) is positioned on the open-close ring (1.3) and that has a circular shape wrapping around the open-close ring (1.3).

5. The anchorage system according to claim 1, wherein the grouting ring (1.3.2) comprises a grouting pipe (1.3.2.1) in hollow tube form that originates from the grouting ring (1.3.2) and extends over a well outlet located at the ground surface.

6. The anchorage system according to claim 5, wherein the grouting pipe (1.3.2.1) contains grouting coupling (1.3.2.1.1) at the end of the grouting pipe, that is not connected to the open-close ring (1.3).

7. The anchorage system according to claim 1, wherein the anchorage body (1) comprises a cable locking apparatus (3) that is positioned at anchorage end once the anchorage is settled inside hole and that ensures passing the anchorage cable (4).

8. The anchorage system according to claim 1, wherein comprising tensioning element manufactured out of fabric on the cutter vanes (1.2.1) that ensures the coupling between cutter vanes (1.2.1) that is positioned in a way covering the cutter vanes (1.2.1) that enables the collective movement of all cutter vanes (1.2.1) during the deployment of cutter vanes (1.2.1), that distributes inbound weight imposed on the cutter vanes (1.2.1) to a broader area and that enables injection by discharging in-between surface areas.

* * * * *